US006510822B2

(12) United States Patent
Weiss

(10) Patent No.: US 6,510,822 B2
(45) Date of Patent: Jan. 28, 2003

(54) CRANKSHAFT FOR A RECIPROCATING INTERNAL COMBUSTION ENGINE

(75) Inventor: Edwin Weiss, Gummersbach (DE)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/008,205

(22) Filed: Nov. 8, 2001

(65) Prior Publication Data

US 2002/0056340 A1 May 16, 2002

(30) Foreign Application Priority Data

Nov. 14, 2000 (EP) ..... 00124773

(51) Int. Cl.[7] ..... F02B 75/02
(52) U.S. Cl. ..... 123/48 B; 123/78 E
(58) Field of Search ..... 123/48 B, 78 E, 123/197.1

(56) References Cited

U.S. PATENT DOCUMENTS 4,406,256 A * 9/1983 Akkerman ..... 123/197.1
5,146,879 A * 9/1992 Kume et al. ..... 123/48 B

FOREIGN PATENT DOCUMENTS

DE 42 26 361 A1 4/1994

* cited by examiner

*Primary Examiner*—Noah P. Kamen

(57) ABSTRACT

The invention relates to a crankshaft for a reciprocating internal combustion engine, with the crankshaft having a crankpin (11) with an eccentric sleeve (10), through the rotation of which relative to the crankpin the effective stroke of a crankshaft can be modified. Sleeve (10) can be locked in two positions separated by 180° by means of two locking elements (7, 14). The locking elements are arranged in the crankshaft and are supplied with a hydraulic fluid via feed lines (2, 4), which likewise extend in the crankshaft. A feed line (3) for a fluid can furthermore be provided, this being passed to the inner surface of the sleeve (10) in such a way that a torque about the crankpin (11) can be exerted on said sleeve.

4 Claims, 2 Drawing Sheets

CRANKSHAFT FOR A RECIPROCATING INTERNAL COMBUSTION ENGINE

BACKGROUND OF THE INVENTION

1. Field of the Invention

The invention relates to a crankshaft for a reciprocating internal combustion engine, comprising a crankpin and an eccentric sleeve, which is rotatably mounted on the crankpin by means of a cylindrical inner surface, the sleeve having at least one locking recess, in which a locking element can engage in order to cancel the rotatability of the sleeve about the crankpin.

2. Disclosure Information

A crankshaft of the type described is generally known from DE 197 03 948 C1. A crankshaft of this kind is used to change the compression ratio of a reciprocating internal combustion engine by shortening or lengthening the effective length of the connecting rod as described below.

The connecting rod is attached by its first end in a known, articulated manner to the piston, which moves up and down in the cylinder of the engine, and the connecting rod is arranged in an articulated manner by its second end on the crankpin of the crankshaft. The connecting rod converts the linear upward and downward movement of the piston into a continuous rotary motion of the crankshaft. According to DE 197 03 948 C1, the connecting rod is mounted on the crankpin by its second end by means of an interposed eccentric sleeve. The eccentric sleeve has a cylindrical inner surface and a cylindrical outer surface, which is eccentric relative to the latter. The effective stroke length which can be defined, together with the connecting rod, as the distance between the axis of rotation of the connecting rod on the piston and the axis of rotation of the crankshaft, differs depending on the rotation of this eccentric sleeve relative to the crankpin. By rotating the eccentric sleeve, it is thus possible to modify the compression that occurs in the swept volume of the engine's piston and hence the behavior of the engine.

In order to be able to perform this modification of the compression in a selective manner, the sleeve disclosed in DE 197 03 948 C1 has a recess on each of its two axial edges, the two recesses lying diametrically opposite relative to the center of the sleeve. Arranged at the end of the connecting rod there is furthermore a locking element, which can be displaced between two positions parallel to the axis of the sleeve. In the first position, this locking element engages with a locking effect in the first recess of the sleeve, while in the second position it engages with a locking effect in the second recess. Since the two recesses lie diametrically opposite one another on the sleeve, the sleeve must rotate through 180° about the crankpin to achieve a change between the two positions of engagement of the locking element. At the same time, the recesses in the sleeve are arranged in such a way in relation to the eccentricity of the sleeve that the maximum and minimum possible effective length of the connecting rod is obtained in the engaged positions of the locking element.

According to DE 197 03 948 C1, a movable mechanism that is independent of the connecting rod is provided at the end of the connecting rod for the purpose of actuating the locking element, being arranged by means of an arcuate stop surface on the edge of the space for the motion of the connecting rod. The extent of the stop surface must be large since the end of the connecting rod moves during the operating of the engine and it must be possible to switch over the locking element in every possible position. Accordingly, DE 197 03 948 C1 results in a relatively complex, expensive and fault-prone mechanism for actuating the locking element and modifying the effective length of the connecting rod.

Faced with this situation, it is the intention of the present invention to improve a crankshaft of the type stated at the outset in such a way that it can be produced at lower cost, with robust, reliable operation.

SUMMARY OF THE INVENTION

According to the present invention, a crankshaft for a reciprocating internal combustion engine comprises a crankpin that is arranged eccentrically with respect to the axis of rotation of the crankshaft. The crankshaft furthermore comprises an eccentric sleeve, which is rotatably mounted on the crankpin by means of a cylindrical inner surface and a cylindrical outer surface which is eccentric with respect to the inner surface. One end of a connecting rod can be mounted on the outer surface of the sleeve, it being possible, thanks to the eccentricity of the sleeve, to modify the effective length of the connecting rod together with the stroke radius by rotating the sleeve about the crankpin. The sleeve has at least one locking recess or pocket, in which a locking element can engage in order to cancel the rotatability of the sleeve and thus lock the sleeve on the crankpin. Locking the sleeve has the effect of fixing the current effective length of the connecting rod.

The crankshaft is distinguished by the fact that the at least one locking element is arranged on the crankshaft and that the crankshaft contains control means for the actuation of the locking element. Unlike the prior art, the locking element is thus not arranged in the connecting rod but on or in the crankshaft. This has the advantage that control means for actuating the locking element can likewise be provided on or in the crankshaft, where they are easier to accommodate in terms of manufacturing and where they are protected from disturbing influences. Moreover, there is no need for complex and bulky additional elements in the space below the connecting rod in order to actuate the locking element. The crankshaft according to the invention thus also permits a more compact engine construction.

According to a preferred embodiment of the present invention, control means that are provided in the crankshaft, comprising feed lines for a hydraulic fluid, and the locking elements are hydraulically actuable. The passages for hydraulic fluid in the crankshaft lead to the pressure-actuated locking elements. There is sufficient space for passages of this kind in the crankshaft and the arrangement of the passages is advantageous in terms of manufacturing, not the least because oil passages for lubricating the bearings generally have to be provided in the crankshaft anyway.

The hydraulically actuable locking elements contain a swept volume for the accommodation of hydraulic fluid and a plunger that can be moved by a change in the volume of the swept volume. The locking elements are preferably preloaded mechanically into a position of rest, from which they can be moved when a hydraulic (excess) pressure is applied. The position of rest of the locking element can correspond either to engagement of the locking element in the recess of the sleeve or to retraction of the locking element from the sleeve.

According to another aspect of the invention, the crankshaft has at least one fluid feed passage leading to the outer surface of the crankpin (and hence to the inner surface of the sleeve), and the sleeve is shaped in such a way on its inner surface that feeding in a fluid via the fluid feed passage produces a torque about the crankpin at the sleeve. This means that the rotation of the sleeve about the crankpin required to modify the effective length of the connecting rod can be actively performed or assisted by the selective supply of a fluid via the fluid feed passage. The crankshaft according to the invention is thus not dependent on the rotation of the sleeve after the release of the locking taking place spontaneously on the basis of the forces that are acting; on the contrary, this rotation can be performed actively and in a predetermined direction.

There are various possibilities for the shape of the sleeve on its inner surface that leads to the desired torque when a fluid is supplied. In particular, the sleeve can have an encircling sawtooth shape on its inner surface, the sawteeth extending radially. When a fluid is fed into the asymmetric recesses between the sawteeth, force components of different magnitude are produced in the positive and negative directions of rotation, with the overall result that the desired propulsion in one direction of rotation occurs.

According to a development of the last-mentioned embodiment, the crankshaft has a fluid outlet passage, via which fluid that has been fed to the inner surface of the sleeve via the abovementioned fluid feed passage can be discharged. The fluid is thus fed via the fluid feed passage and the inner surface of the sleeve into the fluid outlet passage in a single stream, and it can preferably be guided in a circuit. On its way between the fluid feed passage and the fluid outlet passage, the fluid enters into interaction with the sleeve and gives rise to the desired torque there.

The crankshaft preferably comprises two locking elements, which are arranged offset by 180° on the crankpin. As used herein the term "on the crankpin" includes a situation where the locking elements are arranged in the crankpin itself or on its edge, i.e. in the so-called webs of the crankshaft, from where they can engage in the locking recess in the sleeve. Preferably, only a single locking recess is provided in the sleeve, thus allowing only one of the locking elements to engage in this recess at any given time. Since the locking elements lie opposite one another at 180°, they can be used to bring about corresponding locking of two positions of the sleeve that are rotated by 180° relative to one another. At the same time, the arrangement of the recess in the sleeve and of the locking elements is preferably chosen in such a way that the maximum possible and minimum possible effective length of the connecting rod respectively are achieved in the locked positions.

To enable the feed lines to the locking elements and, where appropriate, the fluid feed passage to be accommodated efficiently, the crankshaft preferably has an internal hole running along its length, in which separate passages for the abovementioned lines are arranged.

BRIEF DESCRIPTION OF THE DRAWINGS

The invention is explained below by way of example with the aid of the figures, of which.

DETAILED DESCRIPTION OF THE PREFERRED EMBODIMENTS

Figure 1:
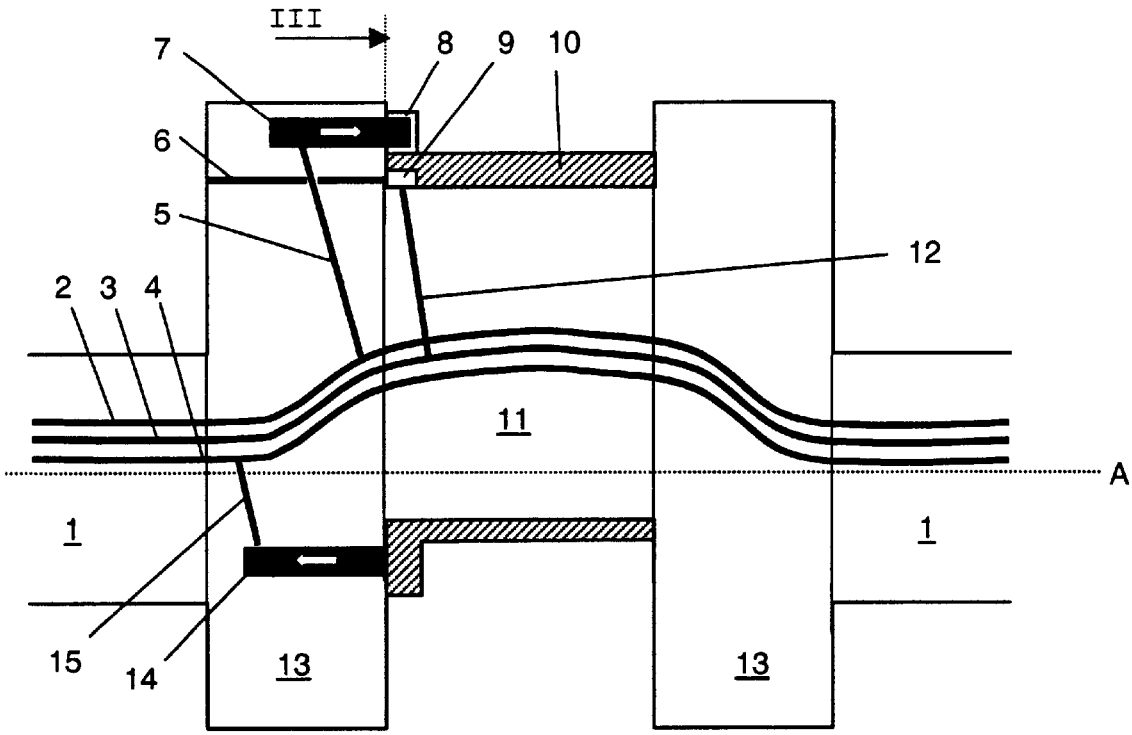
FIG. 1 is a schematic cross section through those parts of a crankshaft that are of significance to the invention.

FIG. 1 illustrates part of a crankshaft according to the present invention. Conventionally, the crankshaft comprises shaft journals 1, which are concentric with the axis of rotation A of the crankshaft, and cylindrical crankpins 11 arranged eccentrically with respect to the axis of rotation A. The crankpins 11 and the shaft journals 1 are connected by crank webs 13 that, by virtue of their shape and distribution of material, ensure symmetrical, balanced weight distribution with respect to the axis of rotation A. The portion of the crankshaft that is illustrated in FIG. 1 is provided for each cylinder of the associated combustion engine, but the corresponding crankpins have an angular offset relative to one another about the axis of rotation A.

The end of a connecting rod (not shown) is arranged rotatably around the crankpin 11, the other end of the connecting rod being connected in an articulated manner to a piston of the engine. In the case of a crankshaft according to the invention, the connecting rod is mounted on the crankpin 11 by means of an interposed sleeve 10. This has the special characteristic that its cylindrical inner surface, by means of which it is mounted on the crankpin 11, is offset eccentrically relative to the likewise cylindrical outer surface. In FIG. 1, this is reflected in the fact that sleeve 10 is thicker in the upper section than in the lower section. It is thus possible to modify the position of the effective axis of rotation of a mounted connecting rod and hence the effective stroke of the crankshaft and the top dead center position of the piston in the engine by turning the sleeve 10 about the crankpin 11. This in turn makes it possible to vary the compression ratio of the engine since the volume of the combustion chamber in the cylinder is increased or reduced, depending on the position of sleeve 10.

Locking elements 7 and 14 are provided to enable sleeve to be locked in particular rotational positions in order to set a desired effective stroke of the crankshaft. These locking elements are arranged in the crankshaft, in particular in one of the webs 13 connecting the shaft journal 1 to the crankpin 11 in the embodiment shown in FIG. 1.

In its edge facing the locking elements 7, 14, sleeve 10 has a recess 8 (see FIGS. 2 and 3), in which the locking elements can engage. In the situation illustrated in FIG. 1, locking element 7 situated radially on the outside engages in this recess 8. This engagement blocks rotation of sleeve 10 about crankpin 11. In the basic mode with the engine stationary, the spring-loaded plunger of locking element 7 is in engagement with the recess 8 in the sleeve 10, as illustrated in FIG. 1. The second locking element 14 situated opposite is preloaded in the opposite direction by a spring, with the result that its plunger is pulled away from sleeve 10. Since sleeve 10 has only one recess 8, only one of the two locking elements 7 or 14 can engage in it at any given time.

To switch the locking elements 7 and 14 out of their spring-loaded positions of rest, a second plunger is connected to the first plunger by a rod (not shown). The second plunger can be subjected to an oil pressure fed to the locking element, whereupon it exerts a pull on the other plunger via the rod and, if the pressure is sufficiently high, moves it out of its position of rest. Starting from the situation shown in FIG. 1, the plunger of the outer locking element 7 can be disengaged in this way from the recess 8 in sleeve 10, allowing sleeve 10 to rotate about crankpin 11. After performing a rotation of 180°, the recess 8 lies in front of the radially inner locking element 14, the plunger of which can then be moved into engagement with the recess 8 by an appropriate hydraulic pressure. Sleeve 10 is then locked in its second position relative to crankpin 11, thereby setting the other extreme (the minimum in FIG. 1) of the effective stroke of the crankshaft.

Feed lines 2, 4 for a hydraulic oil are provided for hydraulic actuation of the locking elements 7 and 14.

Branching off from the two feed lines 2 and 4 at each cylinder are lines 5 and 15 respectively, which supply the corresponding locking element 7 or 14 with hydraulic oil from the main line. The oil pressure in feed lines 2 and 4 can thus be used to selectively actuate the locking elements 7 and 14. Thus, the compression ratio of the engine can then be set in accordance with the engine speed and engine load by rotating the sleeve 10.

FIG. 1 furthermore shows another oil passage 3, which runs parallel to passages 2 and 4 along the length of the crankshaft. This passage 3 is connected to the outer surface of the crankpin 11 by line 12, allowing lubricating oil to be fed to the bearing surface of sleeve 10 on the crankpin 11.

Passage 3 may also be used to feed a fluid, preferably oil, to the inner surface of the sleeve 10 in such a way that a torque about the axis of the bearing journal 11 is produced there. This torque can assist or produce a desired rotation of sleeve 10 when the latter is not locked. The inner surface of sleeve 10 is configured in a suitable way for this purpose, e.g. by having an encircling sawtooth outline with chambers 9 (see FIGS. 2 and 3). After passing through chambers 9, the fluid supplied is discharged via a passage 6 in the web 13 of the crankshaft. Since the fluid is preferably a lubricating oil, passage 6 can end freely in the space surrounding the crankshaft.

Two independent oil passages are incorporated into the crankshaft in order to feed oil separately to the bearings and to locking elements 7 and 14. The oil can be supplied via the main bearings of the bearing sleeve and via an embedded tube in the crankshaft at the front end of the crankshaft. The local connections for the sleeves and the control valves are drilled for each consuming unit. A simple sealing ring is all that is required to seal off the oil supply at the front end of the crankshaft, where it enters the crankshaft. For simplicity of arrangement and production, the control valves 7 and 14 are preferably arranged in two longitudinal holes in the crankshaft.

The control valve 7, 14 is a bilateral plunger arrangement with a return spring. The valve comprises a straight tube with an opening between the plungers. The tube improves the arrangement of the valve in the crankshaft. A small pin can additionally be inserted vertically into the web to fix the tube, preventing rotation of the tube in the hole. The two plungers of a valve are connected by a rod. They are welded, brazed or stamped.

The oil flow to the control valves 7, 14 is preferably controlled by electromagnetic valves. The oil pressure is produced by an enlarged oil pump or a dual oil pump.

Figure 2:
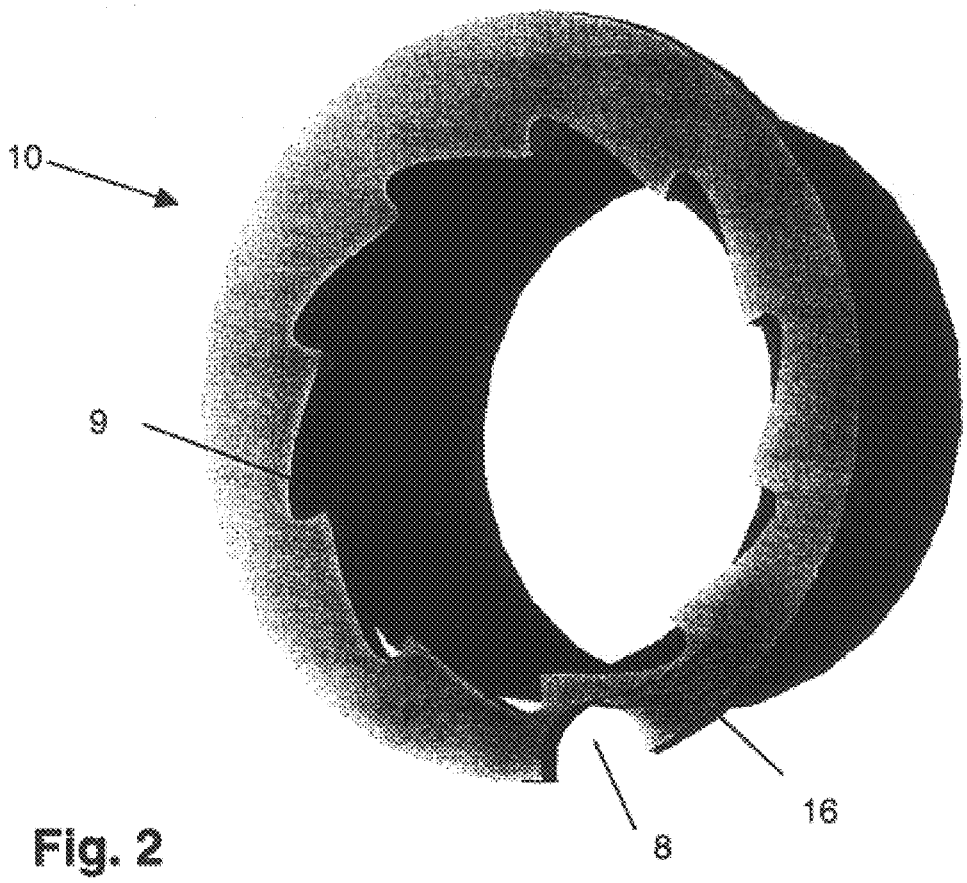
FIG. 2 is a perspective representation of the sleeve of the crankshaft in FIG. 1.

FIG. 2 shows the sleeve 10 in perspective. It shows a radially extending flange of the sleeve 10, which has the semicircular recess 8 and, on the inside, a sawtooth profile with asymmetric chambers 9. On one side, the recess 8 can have a ramp 16, which extends over a certain length and entails a continuous reduction in the thickness of the flange toward the recess 8. The ramp 16 allows a locking element pressing against the flange to move axially in the direction of the recess over a relatively long distance when the sleeve 10 is rotated, with the result that it does not have to snap in all at once at the instant in which the recess 8 is precisely opposite to it.

Figure 3:
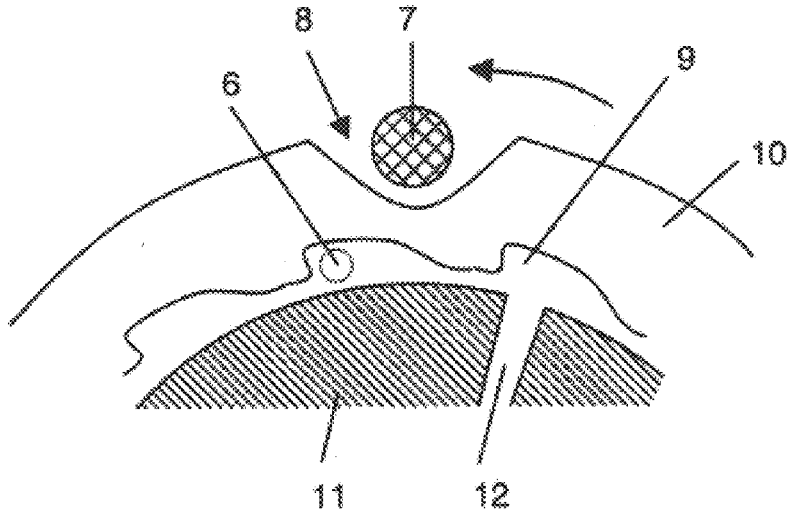
FIG. 3 is a plan view of the edge of the sleeve from direction III in FIG. 1.

FIG. 3 shows a plan view from direction III in FIG. 1. It shows a piece of the flange of the sleeve 10 and a partial section through the shaft journal 11. In particular, it can be seen that the fluid feed passage 12, which is formed in the shaft journal 11, leads to a chamber 9 on the inside of the sleeve 10. When a fluid, in particular oil for example, is introduced via the feed passage 12, an asymmetric pressure is produced in the circumferential direction owing to the shape of the chamber 9, leading to a net torque (in the counterclockwise direction in FIG. 3, see arrow). When the sleeve is unlocked, an active rotation of the sleeve 10 about the crankpin 11 can be produced by means of this torque.

The position of the fluid outlet passage 6 is furthermore indicated by a broken line in FIG. 3. The fluid fed in to a chamber 9 via the feed passage 12 can flow back out via this passage 6 once the sleeve has been rotated further in the direction of the arrow.

What is claimed is:

1. A crankshaft for a reciprocating internal combustion engine, comprising a crankpin (11) and an eccentric sleeve (10) which is rotatably mounted on the crankpin by means of its cylindrical inner surface, with the sleeve having at least one locking recess (8) which a plurality of hydraulically actuable locking elements can engage in order to cancel the rotatability of the sleeve about the crankpin, with the locking elements being arranged on the crankshaft such that the locking elements are preloaded mechanically into a position of rest, and with the locking elements being movable out of the position of rest when a hydraulic pressure is applied by a control means comprising hydraulic feed lines (2, 4, 5, 15) contained within the crankshaft, and with the crankshaft further comprising at least one emerging fluid feed passage (3,12) leading to the outer surface of the crankpin (11), and wherein the sleeve (10) is shaped in such a way on its inner surface that feeding in a fluid via the emerging fluid feed passage (3,12) produces a torque about the crankpin at the sleeve.

2. A crankshaft as claimed in claim 1, wherein the sleeve (10) has a radial sawtooth shape running around its inner surface.

3. A crankshaft as claimed in claim 1, further comprising a fluid outlet passage (6), via which fluid that has been fed to the inner surface of the sleeve via the fluid feed passage (3, 12) can be discharged.

4. A crankshaft as claimed in claim 1 wherein locking elements (7, 14), are arranged offset by 180° on crankpin (11), with said locking elements being engageable alternately in a locking recess (8) in said sleeve (10).

* * * * *